US007179206B2

(12) United States Patent
Backes et al.

(10) Patent No.: US 7,179,206 B2
(45) Date of Patent: Feb. 20, 2007

(54) NON-WEIGHT BEARING FOOT AND LEG EXERCISING APPARATUS

(75) Inventors: Larry P. Backes, Libertyville, IL (US); Patrick Sasser, Grayslake, IL (US)

(73) Assignee: Home Stretch Products, Inc.

( * ) Notice: Subject to any disclaimer, the term of this patent is extended or adjusted under 35 U.S.C. 154(b) by 171 days.

(21) Appl. No.: 10/798,205

(22) Filed: Mar. 11, 2004

(65) Prior Publication Data

US 2005/0209067 A1 Sep. 22, 2005

(51) Int. Cl.
*A63B 21/00* (2006.01)

(52) U.S. Cl. ..... 482/80; 482/907

(58) Field of Classification Search ..... 482/80, 482/79, 74, 907, 96, 124, 121, 125, 105; 602/23

See application file for complete search history.

(56) References Cited

U.S. PATENT DOCUMENTS

| | | | | | |
|---|---|---|---|---|---|
| 324,498 | A | | 8/1885 | Surbaugh | |
| 874,446 | A | * | 12/1907 | Slater | 602/23 |
| 2,467,943 | A | | 4/1949 | Mikell | |
| 2,664,886 | A | * | 1/1954 | Coffman | 602/15 |
| 3,834,694 | A | | 9/1974 | Pridgen | |
| 4,251,070 | A | | 2/1981 | Leseberg | |
| 4,728,103 | A | | 3/1988 | Fulton | |
| 5,167,601 | A | | 12/1992 | Frappier | |
| 5,203,754 | A | * | 4/1993 | Maclean | 482/124 |
| 5,256,119 | A | * | 10/1993 | Tudor | 482/474 |
| 5,382,224 | A | * | 1/1995 | Spangler | 602/23 |
| 5,399,155 | A | | 3/1995 | Strassburg | |
| 5,582,579 | A | | 12/1996 | Chism | |
| 5,776,090 | A | | 7/1998 | Bergmann | |
| 5,853,354 | A | * | 12/1998 | Kubota | 482/80 |
| 5,887,591 | A | | 3/1999 | Powell | |
| 6,110,078 | A | | 8/2000 | Dyer | |
| 6,206,807 | B1 | | 3/2001 | Cowans | |
| 6,210,348 | B1 | | 4/2001 | Reed | |
| 6,368,258 | B1 | | 4/2002 | Emlaw | |
| 6,379,321 | B2 | | 4/2002 | Gaylord | |
| 6,425,843 | B1 | * | 7/2002 | Storfer et al. | 482/79 |
| 6,602,216 | B1 | | 8/2003 | Nordt, III | |

* cited by examiner

*Primary Examiner*—Jerome Donnelly
(74) *Attorney, Agent, or Firm*—Robert L. Marsh

(57) ABSTRACT

A device for exercising the plantar fascia has a first member positionable under the ball of a foot, and a second member positionable under the toes of the foot. A third member having an eye attaches to the ankle. A first line extends from the first member and a second line extends from the second member and through the eye at the ankle. By pulling on the first and second lines, the plantar fascia is stretched.

5 Claims, 4 Drawing Sheets

NON-WEIGHT BEARING FOOT AND LEG EXERCISING APPARATUS

The present invention relates to a device for stretching the plantar fascia of the foot and associated muscles.

BACKGROUND OF THE INVENTION

The plantar fascia is a fibrous tissue that spans between the medial tubercle of the calcaneus (or heel bone) to the metatarsals (or toe bones). When a person stands, the plantar fascia is stretched under the load of the person's weight. This is known as the "bowstring effect." Should the toes and ankle be dorsiflexed (or hyperextended upward toward the shin) the plantar fascia is stretched even further. This is called the "windlass effect."

Plantar fasciitis is a condition that occurs to a wide range of the adult population. It is seen in both sedentary and active individuals. The cause of plantar fasciitis is unclear; however, a common theory is that the plantar fascia is repetitively injured causing partial tears and chronic inflammation. As these micro tears heal, scar tissue forms reducing the elasticity of the plantar fascia and contributing to further tearing and inflammation.

Prolonged standing, obesity, pronation of the foot while walking, running, jumping and other activities can cause repeated injuries to the origin of the plantar fascia at its insertion on the medial tubercle of the calcaneus of the foot. The injuries result in the repetitive tearing of tissue, inflammation, and the formation of scar tissue in the plantar fascia causing limitation in flexibility. The injury causes intense pain in the bottom of the foot near the heel. When suffering from injury to the plantar fascia, one incurs the greatest pain in the morning when arising from bed because the plantar fascia has not been exercised during the night and has become stiff and retracted as a result of the long period of inactivity. When one rises from bed and first applies full body weight to his or her feet, the plantar fascia is suddenly stretched resulting in sharp pains to the heel. Studies have shown it is desirable to gradually exercise the plantar fascia by dorsiflexing the toes and ankles, stretching it gradually, especially before one first applies one's body weight to his or her feet.

Some doctors advise their patients who suffer from such injuries to roll a towel and grasp the ends in each hand and press the toes of the injured foot against the center of the towel while using one's arms to pull against the towel to thereby stretch the plantar fascia. The exercise is marginally successful because the patient must stiffen his toes to grip the towel and prevent it from sliding off the end of this foot. The exercise, therefore, requires the flexing of the plantar fascia, and the plantar fascia is not stretched as is needed.

Several devices have been proposed for stretching the plantar fascia, but such devices suffer from some of the same limitations incurred with the towel namely, the device will not stay affixed to the foot in such a manner as to permit the foot to relax and thereby maximize the stretching of the plantar fascia.

Other devices require weight bearing stretching that provide a stretch to the plantar fascia only after the additional micro tears have occurred from the individual standing. Still other devices offer passive stretching of the plantar fascia. These devices require that sufferer to wear bulky splints while they sleep. Patient compliance is low due to the uncomfortable feeling inherent with these devices.

SUMMARY OF THE INVENTION

Briefly, the present invention is embodied in an exercise device for the plantar fascia that includes a first member that is positionable under the ball of the human foot, and a second member positionable under the toes of the human foot. The device includes a strap which is attachable around the ankle just above the foot for which the plantar fascia is to be exercised. The strap has a loop or an eye attached thereto and a first line extends through the eye of the strap around the ankle and connects to the second member. A second line is attached to the first member.

One who desires to exercise his plantar fascia will assemble the strap around his ankle and position the first member under the ball of his foot and the second member around his toes and attach the lines as described above. The lines may have separate handles or the lines may be attached to opposite ends of a single handle such that the patient can exercise one leg by pulling on a single handle. The patient will then use the muscles in his arm to apply force against the two lines to apply pressure to the ball of his foot and to his toes. This force applied will cause the ankle and toes to dorsiflex, and thereby stretch the plantar fascia. By varying the application of force between the toes and the ball of the foot, the plantar fascia can be fully exercised as can also be the Achilles tendon, the calf and hamstring muscles, and the gluteus maximus.

BRIEF DESCRIPTION OF THE DRAWINGS

A better understanding of the present invention can be had after a reading of the following detailed description taken in conjunction with the drawings wherein.

DETAILED DESCRIPTION OF A PREFERRED EMBODIMENT

Figure 1:
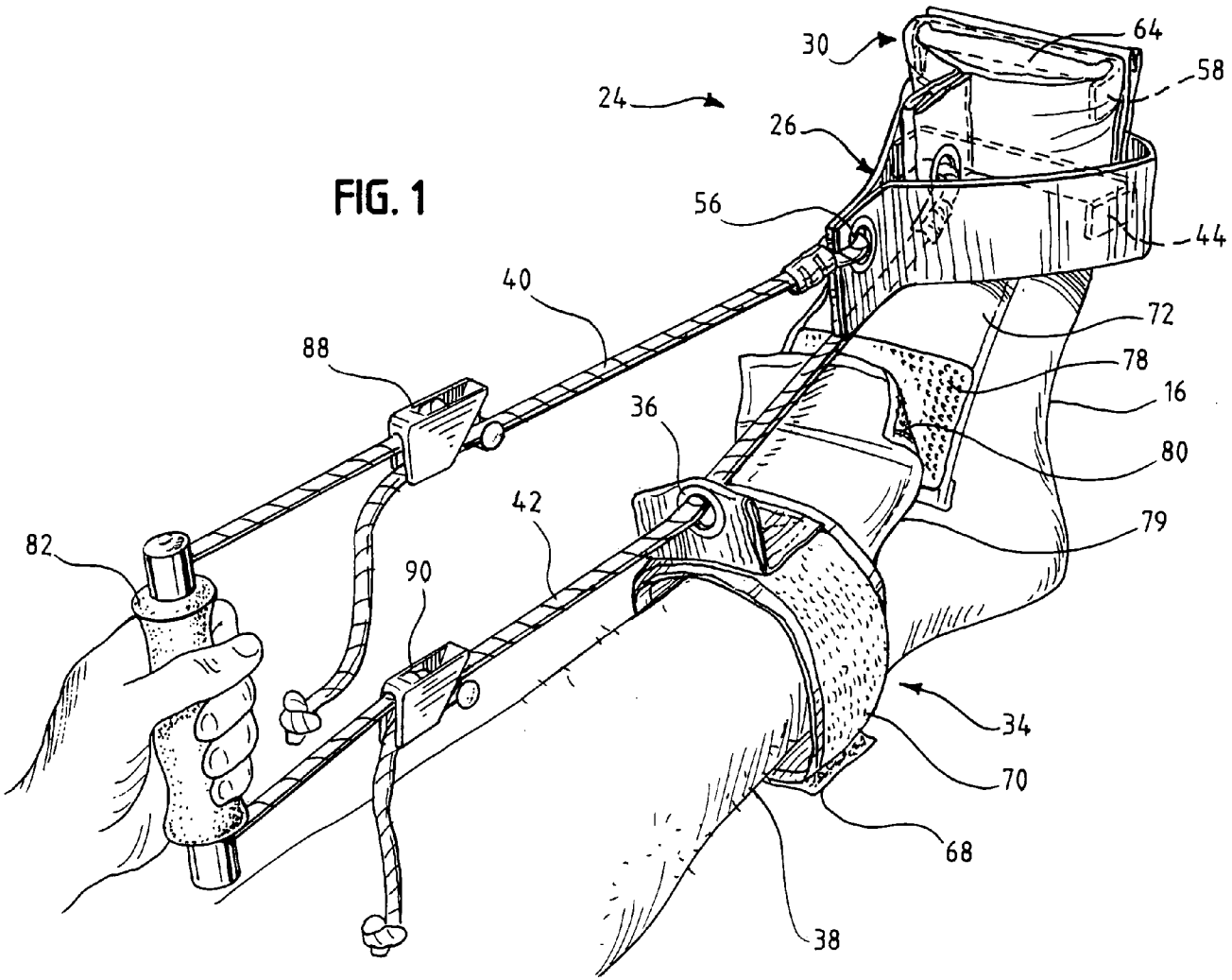
FIG. 1 is an isometric view of the device of the present invention attached to a human foot to thereby exercise the plantar fascia.
Figure 3:
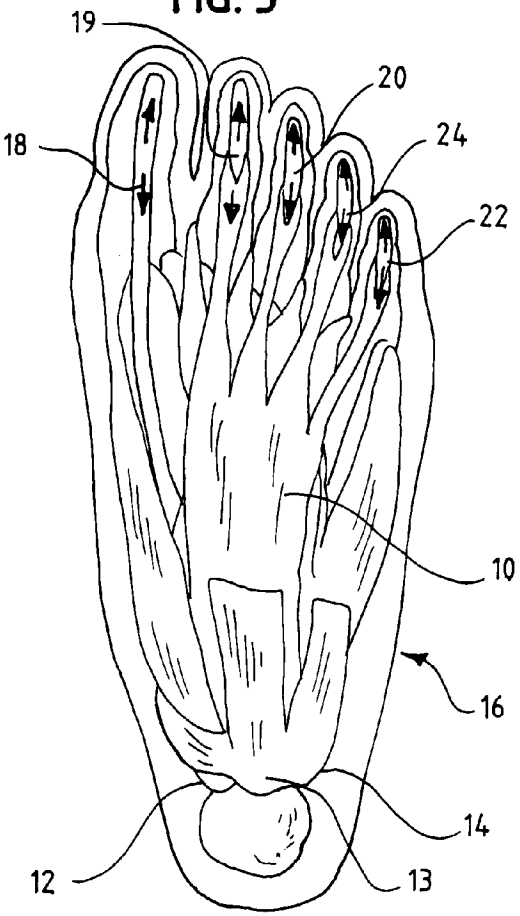
FIG. 3 is a cross-sectional view of the foot shown in FIG. 2 taken through line 3—3 of FIG. 2.
Figure 2:
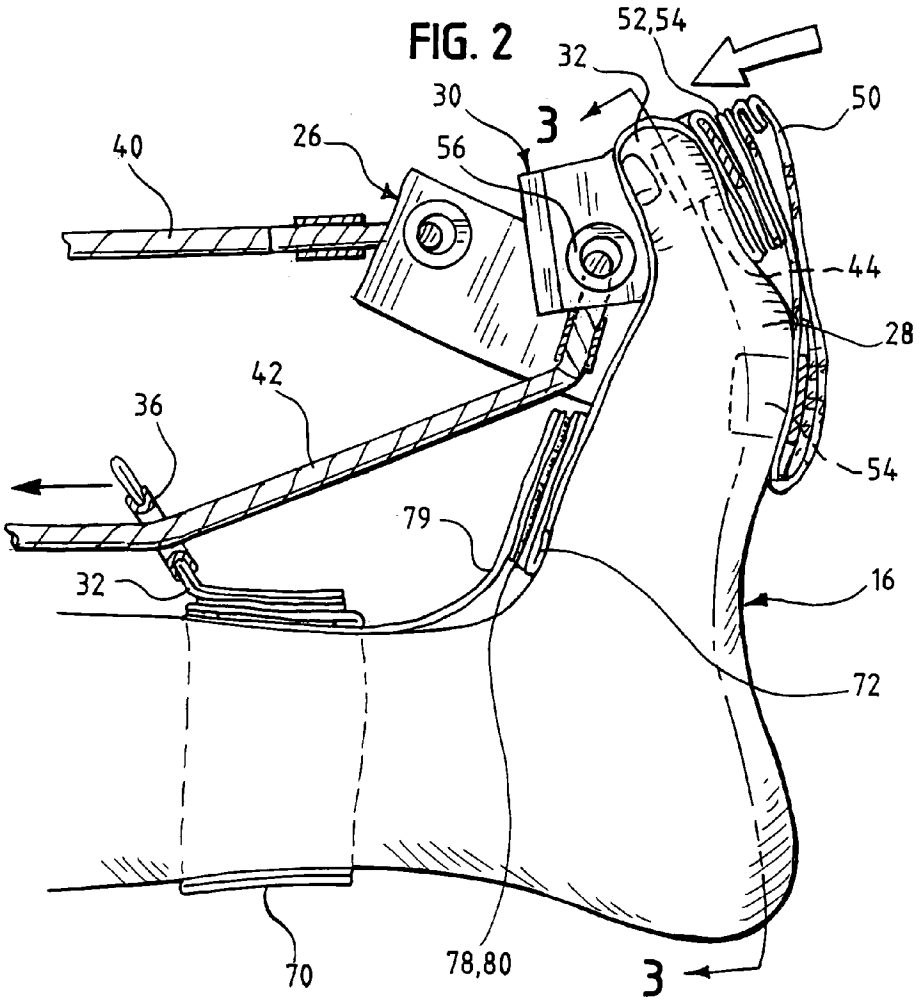
FIG. 2 is a partially cross-sectional view of the device shown in FIG. 1 showing the foot inside the device with the line to the toe section being drawn to exercise the portion of the plantar fascia near the toes.
Figure 5:
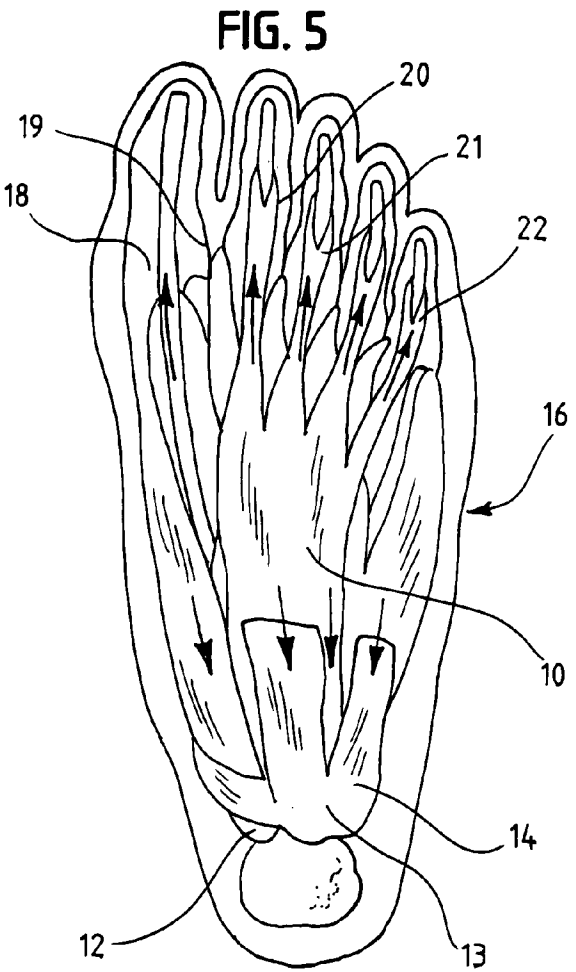
FIG. 5 is a cross-sectional view of the foot shown in FIG. 4 taken through line 5—5 thereof showing the portion of the plantar fascia being exercised.
Figure 4:
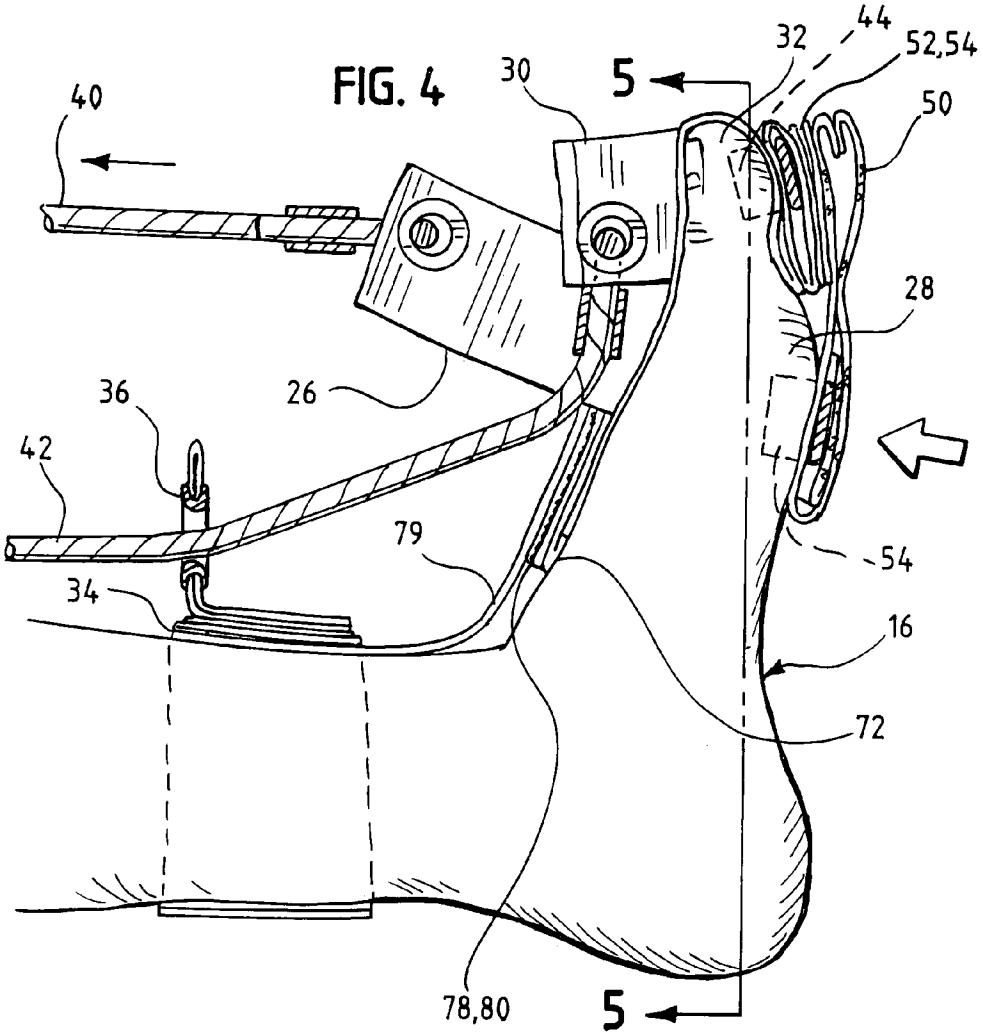
FIG. 4 is a second cross-sectional view of the device showing the foot while the second line is being drawn to stretch the central portion of the plantar fascia.
Figure 6:
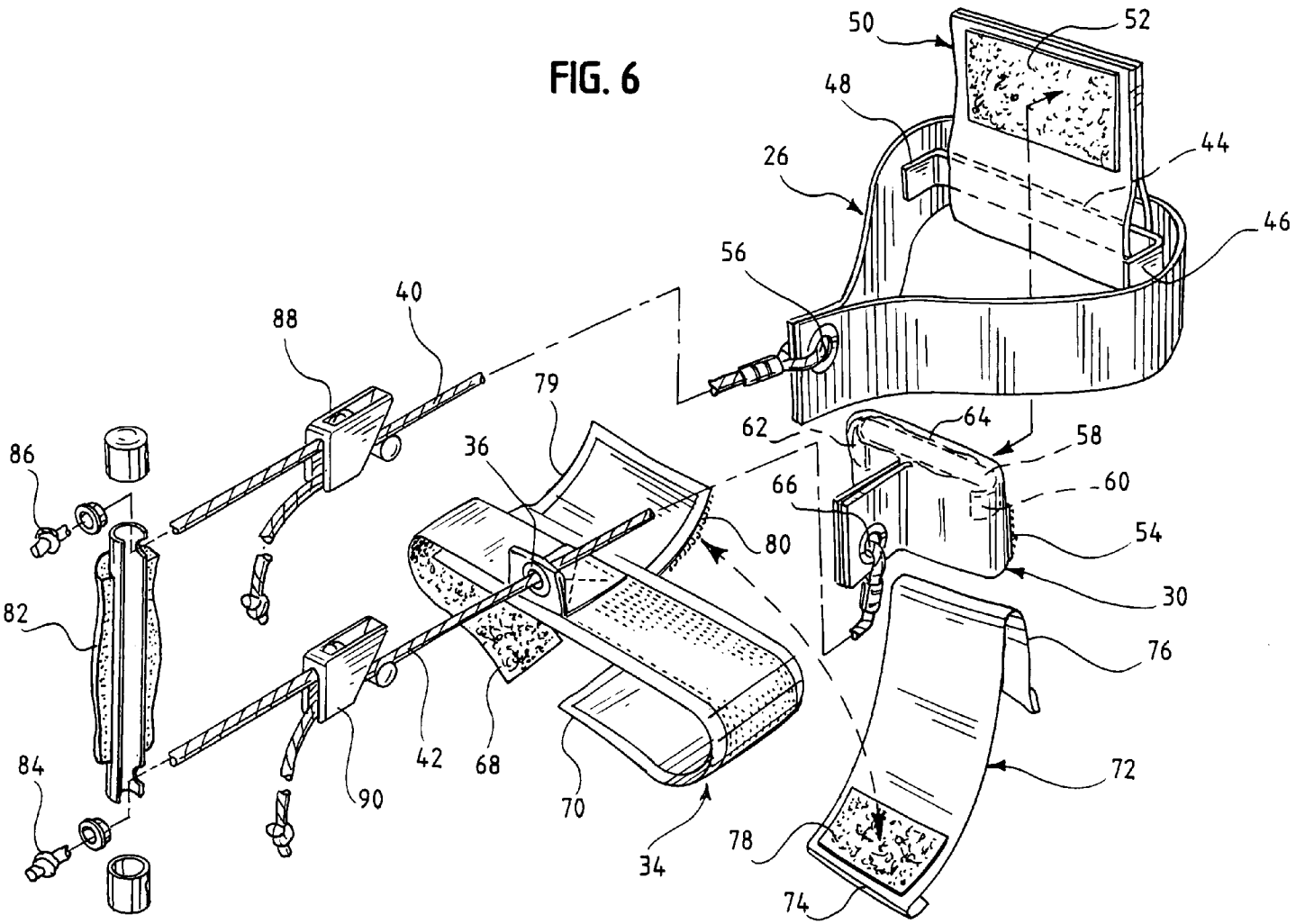
FIG. 6 is an exploded view of the device shown in FIG. 1.

Referring to FIGS. 3 and 5, the plantar fascia 10 is a thick fibrous band of tissue running along the bottom of the foot from the heel to the base of the toes. When placed under too much stress, the plantar fascia becomes stretched too far causing minute tears within the fascia causing inflammation in the fascia and in the surrounding tissue. The tears are soon covered with a scar tissue, but the scar tissue is less flexible than healthy tissue and the scar tissue tends to aggravate the problem. The injury is called plantar fasciitis and is most severe in the morning when one gets out of bed or at the beginning of a run. This is because during the night or prior to exercising, the plantar fascia has become contracted and stiff and the sudden stretching of the plantar fascia, caused by applying weight to the foot in the morning, or at the beginning a run, stretches the plantar fascia unduly and aggravates the injured portions of the tissue.

The plantar fascia attaches at three points 12, 13, 14 to the heel of the foot 16 and at five point 18, 19, 20, 21, 22 to each of the five toes of the foot. Stretching the plantar fascia can be accomplished by drawing the ball of the foot towards the pelvis to stretch the central portion of the plantar fascia and the portion near the heel, and by drawing the toes toward the ankle to stretch the portion near the toes.

Referring to FIGS. 1, 2, 4 and 6, a device 24 is provided to stretch the plantar fascia 10 and includes a first strap 26 that is positionable under the ball 28 of the foot, a second strap 30 positionable under the toes 32 of the foot, a third strap 34 having an eye 36 attached thereto for extending around the ankle 38, a first line 40 attachable to the first strap 26 and a second line 42 attachable to the second strap 30. The first, second, and third straps 26, 30, 34 are preferably made of a durable, flexible, comfortable material such as canvas.

To provide a rigid surface under the ball 28 of the foot 16 a metal plate 44 is provided having a generally planar central portion and curved outer end portions 46, 48, the curved portions 46, 48 spaced sufficiently far apart for the central portion of the plate 48 to extend across the width of the largest foot to which the device 24 is to be attachable. The plate 44 extends through a loop of fabric at one end of a generally rectangularly shaped retainer 50. The retainer 50 retains the metal plate 44 in its desired orientation across the ball 28 of the foot by adjustably connecting to the second strap 30 by means of a hook and loop connector one portion 52 of which is attached to a surface of the retainer 50 and the second portion 54 of the hook and loop is attached to a mated surface of the second strap 30. The first strap 26 is sized to fit around the ball 28 of the foot and around the curved outer ends 46, 48 of the metal plate 44 and the first strap 26 has an eye 56 to which the first line 40 is attached. The first strap 26 is also retained by retainer 50.

The second strap 30 has sewn into a pocket thereof, not shown, a second metal plate 58 having an elongate central portion and curved outer ends 60, 62 spaced from one another a distance sufficient for the central portion of the plate 58 to fit under the toes 32 of the foot 16 and thereby provide rigidity for applying pressure to the bottom of the toes 32. The second strap 30 has a closed outer end 64 to thereby retain the second plate 58 below the toes 32. The second strap 30 also has an eye 66 positioned opposite the second plate 58 to which the second line 42 is attached.

The third strap 34 has first and second ends 68, 70 that wrap around the ankle 38 and attach to one another by means of a suitable connector such as hook and loop connectors, not shown. The eye 36 is attached to the central portion of the third strap 34 and is sized to slideably receive the second line 42.

The position of the third strap 34 with respect to the ankle 38 is maintained by means of a spacing strap 72 having a first end 74 adjustably attachable to the third strap 34 by means of a hook and loop connector with one portion 78 attached to the spacer strap 72 and the second portion 80 attached to a tongue 79 connected to the third strap 34. The second end 76 of the spacer strap 72 is sufficiently long to fit within the open end of the second strap 30 and around the distal end of the toes 32 to thereby retain the second end 74 with respect to the second strap 30.

In the preferred embodiment, the first and second lines 40, 42 are attachable to opposite ends of a single handle 82 and have knots 84, 86 at their ends to prevent the removal of the lines 40, 42 from the handle 82. The lengths of the two lines 40, 42 are adjustable by means of locking adjustments 88, 90 of the type known in the art. Accordingly, the lines 40, 42 can be adjusted to the lengths of the arms and the legs of the person making use of the device 24.

To make use of the device 24, the second end 76 of the spacer strap 72 is folded over and inserted into the open end of the second strap 30 and secured over the ends of the person's toes 32 such that the second metal plate 58 is positioned under his or her toes 32. The retainer 50, with the first metal plate 44 therein is attached by means of the hook and loop connectors 52, 54 such that the first metal plate 54 is positioned across the ball 28 of the foot. Thereafter, the first strap 26 is positioned around the ball 28 of the foot 16. The third strap 34 is positioned around the ankle 38 and retained in position by attaching the connectors 78, 80 to the spacer strap 72. Finally, the user will adjust the length of the lines 40, 42 such that he or she can apply pressure to the ball and toes of his or her foot by pulling with one arm against the handle 82.

The user will use the strength of his or her arm to pull on the handle 82 while the knee remains straight to apply pressure against the first and second plates 44, 58. By pulling one end of the handle 82, the user can apply pressure to the ball 28 of the foot and thereby stretch the central portion of the plantar fascia 10 as shown in FIG. 5, or by pulling the other end of the handle 82, apply pressure below the toes of the foot 32, thereby stretching the forward end of the plantar fascia 10 as shown in FIG. 3. When both ends of handle 82 are pulled simultaneously, pressure is applied to the toes 32 and the ball 28 of the foot, thereby stretching the entire plantar fascia 10 at the same time. The angle of force of line 42 created between the eye 66 of strap 30 and the eye 36 of strap 34 to the foot 16 is sufficiently small to prevent strap 30 from releasing from the toes 32 and therefore the user does not fear that the device will slide off of his or her foot as he applies pressure to the toes and therefore the user does not have to flex his toes against the force of the device to retain the device on his or her foot as was the case with prior art devices. The eye 36 attached to the third strap 34 draws the toes towards the shin, thereby maximizing the pressure applied to the toes 32 by drawing upon the second line 42 without pulling the second strap 30 off the ends of the toes 32. Strap 26 is connected to strap 30 by hook and loop fasteners that assist in anchoring strap 30 on the toes during the exercising of the plantar fascia.

As can be seen there has been disclosed a device 24 for exercising the plantar fascia 10 of the foot 16, which will be retained on the foot without requiring the user to flex muscles of the foot that would interfere with the effectiveness of the exercise. The device 24 also provides the ability to exercise different portions of the plantar fascia 10. Furthermore, the device can provide exercise to the Achilles tendon, the calf and hamstring muscles, and the gluteus maximus without applying weight to the leg and foot by increasing the pull on the handle 82.

While the present invention has been described with respect to a single embodiment, it will be appreciated that many modifications and variations may be made without departing from the true spirit and scope of the inventions. It is therefore the intent of the appended claims to cover all such modifications and variations which fall within the spirit and scope of the invention.

What is claimed:

1. A device for exercising the plantar fascia of a foot comprising a first member positionable under the ball of said foot, a second member positionable under the toes of said foot, attachment means attachable around the ankle above said foot, a loop on said attachment means, a first line attached to said first member, and a second line extending through said loop to said second member a first handle connected to said first line and a second handle connected to said second line wherein said first and said second lines are pulled to stretch said plantar fascia.

2. A device for exercising the plantar fascia of a user's foot comprising a first member positionable under the toes of said foot, a second member attachable to the ankle above said foot, a loop on said second member, and a line having a first end, a second end and a length extending from said first end to said second end, said second end having a handle connected thereto and suitable for grasping by said user's hand said length of line extending through said loop and said second end connected to said first member wherein said user can pull handle and said line will pull the user's toes toward his ankle and will stretch said plantar fascia, and a spacer having a first end attached to said first member and a second end attached to said second member for fixing the spacing of said first member from said second member.

3. The device of claim 1 and further comprising a handle having a first end and a second end, said first line attached to said first end of said handle, and said second line attached to said second end of said handle.

4. The device of claim 3 wherein the lengths of said first line and said second line are adjustable.

5. The device of claim 1 and further comprising a spacer means for fixing the spacing of said second member from said attachment means.

* * * * *